US009013107B2

(12) United States Patent
Yang et al.

(10) Patent No.: US 9,013,107 B2
(45) Date of Patent: Apr. 21, 2015

(54) LOAD DRIVING APPARATUS RELATING TO LIGHT-EMITTING-DIODES

(71) Applicant: Beyond Innovation Technology Co., Ltd., Taipei City (TW)

(72) Inventors: Fu-Kuo Yang, Taipei (TW); Nan-Chuan Huang, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 38 days.

(21) Appl. No.: 14/053,609

(22) Filed: Oct. 15, 2013

(65) Prior Publication Data

US 2014/0210350 A1 Jul. 31, 2014

(30) Foreign Application Priority Data

Jan. 25, 2013 (TW) ..... 102103015 A

(51) Int. Cl.
*H05B 33/08* (2006.01)

(52) U.S. Cl.
CPC ..... *H05B 33/0815* (2013.01); *H05B 33/0827* (2013.01)

(58) Field of Classification Search
USPC ..... 315/122, 186, 210, 297, 307
See application file for complete search history.

(56) References Cited

U.S. PATENT DOCUMENTS

2012/0313536 A1* 12/2012 Kim et al. ..... 315/186
2013/0063047 A1* 3/2013 Veskovic ..... 315/307

* cited by examiner

*Primary Examiner* — Daniel D Chang
(74) *Attorney, Agent, or Firm* — Winston Hsu; Scott Margo

(57) ABSTRACT

A load driving apparatus relating to light-emitting-diodes (LEDs) is provided. In the invention, a compensation voltage on a compensation pin (CMP) of a control chip would not be changed in response to (or with) the variation (i.e. enabling and disabling) of a pulse-width-modulation (PWM) signal for dimming. In other words, the compensation voltage on the compensation pin (CMP) of the control chip would be maintained in unchanging regardless of whether the PWM signal for dimming is enabled or disabled. Therefore, an LED string at the current switching transient does not have the generation of over-shoot current.

18 Claims, 2 Drawing Sheets

LOAD DRIVING APPARATUS RELATING TO LIGHT-EMITTING-DIODES

CROSS-REFERENCE TO RELATED APPLICATION

This application claims the priority benefit of Taiwan application serial no. 102103015, filed on Jan. 25, 2013. The entirety of the above-mentioned patent application is hereby incorporated by reference herein and made a part of this specification.

BACKGROUND OF THE INVENTION

1. Field of the Invention

The invention relates to a capacitive load driving technique, and more particularly to a load driving apparatus relating to light-emitting-diodes (LEDs).

2. Description of Related Art

In a conventional load driving apparatus for LEDs, a current mode control chip may be provided with a pulse-width-modulation (PWM) dimming function, which may be used to adjust the brightness of an LED string. On the other hand, in order to stabilize a DC voltage required for the LED string in operation, an RC series network is usually connected externally to a compensation pin (CMP) of the control chip, so as to compensate a compensation voltage on the compensation pin of the control chip. However, since the compensation voltage on the compensation pin of the control chip changes (i.e. rises) in response to (or with) the variation (i.e. enabling and disabling) of a pulse-width-modulation (PWM) signal for dimming, the LED string at the current switching transient may have the generation of an over-shoot current.

SUMMARY OF THE INVENTION

Accordingly, in order to solve the problems as mentioned in Description of Related Art, an embodiment of the invention provides a load driving apparatus which includes a power conversion circuit, a dimming circuit, a control chip and a compensation circuit. The power conversion circuit is configured to provide a DC output voltage to an LED string in response to a high frequency component of a complex driving signal. The dimming circuit is connected in series with the LED string, and configured to adjust a brightness of the LED string in response to a low frequency component of the complex driving signal.

The control chip is coupled to the power conversion circuit and the dimming circuit, and configured to: generate a high frequency gate pulse-width-modulation (PWM) signal in response to a comparison between a compensation voltage and a ramp signal; generate the complex driving signal to control the operation of the power conversion circuit and the dimming circuit in response to an "AND" operation of a low frequency dimming input PWM signal and the high frequency gate PWM signal; and transfer the compensation voltage to a compensation pin of the control chip in response to an enabling of the low frequency dimming input PWM signal.

The compensation circuit is coupled to the compensation pin, and configured to store the compensation voltage and compensate the compensation voltage so that the power conversion circuit stably provides the DC output voltage. Particularly, the control chip is further configured to stop transferring the compensation voltage to the compensation pin in response to a disabling of the dimming input PWM signal, such that the compensation voltage stored by the compensation circuit does not change with variation (i.e., enabling and disabling) of the low frequency dimming input PWM signal.

In an exemplary embodiment of the invention, the power conversion circuit is further configured to receive a DC input voltage and provide the DC output voltage to the LED string in response to the high frequency component of the complex driving signal. In this condition, the power conversion circuit may be a DC boost circuit, and the DC boost circuit includes an inductor, a first diode, a first capacitor, a power switch and a first resistor. A first terminal of the inductor is configured to receive the DC input voltage. An anode of the first diode is coupled to a second terminal of the inductor, and a cathode of the first diode is coupled to an anode of the LED string to provide the DC output voltage. A first terminal of the first capacitor is coupled to the cathode of the first diode, and a second terminal of the first capacitor is coupled to a ground potential. A drain of the power switch is coupled to the second terminal of the inductor and the anode of the first diode, and a gate of the power switch is configured to receive the complex driving signal. The first resistor is coupled between a source of the power switch and the ground potential.

In an exemplary embodiment of the invention, the dimming circuit includes a dimming switch, a second resistor, and a complex function circuit. A drain of the dimming switch is coupled to the cathode of the LED string. The second resistor is coupled between a source of the dimming switch and the ground potential. An input terminal of the complex function circuit receives the complex driving signal. An output terminal of the complex function circuit is coupled to a gate of the dimming switch.

In an exemplary embodiment of the invention, the complex function circuit includes a third resistor, a second capacitor, and a second diode. A first terminal of the third resistor serves as the input terminal of the complex function circuit to receive the complex driving signal. A second terminal of the third resistor serves as the output terminal of the complex function circuit and is coupled to the gate of the dimming switch. The second capacitor is coupled between the second terminal of the third resistor and the ground potential. An anode of the second diode is coupled to the first terminal of the third resistor, and a cathode of the second diode is coupled to the second terminal of the third resistor.

In an exemplary embodiment of the invention, the control chip may further include a feedback pin. In this condition, the compensation circuit includes a third capacitor coupled between the compensation pin and the feedback pin.

In an exemplary embodiment of the invention, the control chip includes an operational voltage amplifier (OP), a switching unit, a ramp generator, and a control body. The OP is configured to receive a feedback voltage of the second resistor and a predetermined feedback reference voltage, thereby generating an output voltage. The switching unit is coupled to the OP and configured to: receive the output voltage; transfer the output voltage as the compensation voltage to the compensation pin in response to the enabling of the low frequency dimming input PWM signal; and stop transferring the output voltage to the compensation pin in response to the disabling of the low frequency dimming input PWM signal. The ramp generator is configured to generate the ramp signal. The control body is coupled to the OP and the ramp generator, and configured to: receive the compensation voltage, the ramp signal and the low frequency dimming input PWM signal; compare the compensation voltage with the ramp signal so as to generate the high frequency gate PWM signal; and perform the "AND" operation to the low frequency dimming input PWM signal and the high frequency gate PWM signal so as to generate the complex driving signal.

In an exemplary embodiment of the invention, the control chip may further include a gate output pin, and the control body may output the complex driving signal via the gate output pin.

In an exemplary embodiment of the invention, the control chip may further include a complex function input pin, and the control body may receive the low frequency dimming input PWM signal via the complex function input pin. In this condition, the control body may further receive a shutdown signal via the complex function input pin so as to shut down the control chip.

In an exemplary embodiment of the invention, since the control chip includes the feedback pin, so that the OP may receive the feedback voltage of the second resistor via the feedback pin.

In an exemplary embodiment of the invention, the control body may be further configured to determine whether to activate an over current protection mechanism in response to a cross-voltage of the first resistor and a predetermined over current protection reference voltage. In this condition, the control body is further configured to stop generating the complex driving signal in response to the activation of the over current protection mechanism.

In an exemplary embodiment of the invention, the control chip may further include a complex function detection pin, and the control body may receive the cross-voltage of the first resistor via the complex function detection pin.

In an exemplary embodiment of the invention, said load driving apparatus further includes a frequency setting resistor coupled between a first terminal of the first resistor and the complex function detection pin, and is configured to set a frequency of the high frequency gate PWM signal.

In an exemplary embodiment of the invention, the control chip may further include a reference current source coupled between the complex function detection pin and the ramp generator, and is configured to provide a reference current in an initial operation period of the load driving apparatus. Particularly, the complex driving signal is not generated during or in the initial operation period of the load driving apparatus. In this condition, the ramp generator may be further configured to change the frequency of the ramp signal in response to a product voltage of the reference current and the frequency setting resistor, so as to change the frequency of the high frequency gate PWM signal.

In an exemplary embodiment of the invention, the load driving apparatus may further include an output over voltage protection unit coupled between the DC output voltage and the ground potential, and is configured to provide a cross-voltage relating to the DC output voltage by means of voltage-dividing. In this condition, the control body may be further configured to determine whether to activate an over voltage protection mechanism in response to the cross-voltage relating to the DC output voltage and a predetermined over voltage protection reference voltage. Moreover, the control body may be further configured to stop generating the complex driving signal in response to the activation of the over voltage protection mechanism.

In an exemplary embodiment of the invention, the control chip may further have an over voltage sense pin, and the control body may receive the cross-voltage relating to the DC output voltage via the over voltage sense pin.

In an exemplary embodiment of the invention, the control chip may further include an over temperature protection detection unit coupled to the control body, and is configured to provide a temperature sensing voltage relating to the operation temperature of the control chip to the control body. In the condition, the control body may be further configured to determine whether to activate an over temperature protection mechanism in response to the temperature sensing voltage and a predetermined over temperature protection reference voltage. Moreover, the control body may be further configured to stop generating the complex driving signal in response to the activation of the over temperature protection mechanism.

In an exemplary embodiment of the invention, the control chip may further have a power pin to receive the DC input voltage required for operation. Inevitably, the control chip may further include a ground pin coupled to the ground potential.

Based on above, in the invention, the compensation voltage on the compensation pin of the control chip does not change in response to (or with) variation (enabling or disabling) of the PWM signal for dimming (i.e., the low frequency dimming input PWM signal). In other words, regardless of whether the PWM signal for dimming (i.e., the low frequency dimming input PWM signal) is enabled or disabled, the compensation voltage on the compensation pin of the control chip maintains unchanged. Therefore, the LED string at the current switching transient does not have the generation of overshoot current, so as to solve the problems as mentioned in Description of Related Art.

However, it should be noted that the above descriptions and the embodiments below are only used for explanation, and they do not limit the scope of the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Descriptions of the invention are given with reference to the exemplary embodiments illustrated with accompanied drawings. In addition, whenever possible, identical or similar reference numbers stand for identical or similar devices/elements in the figures and the embodiments.

Figure 1:
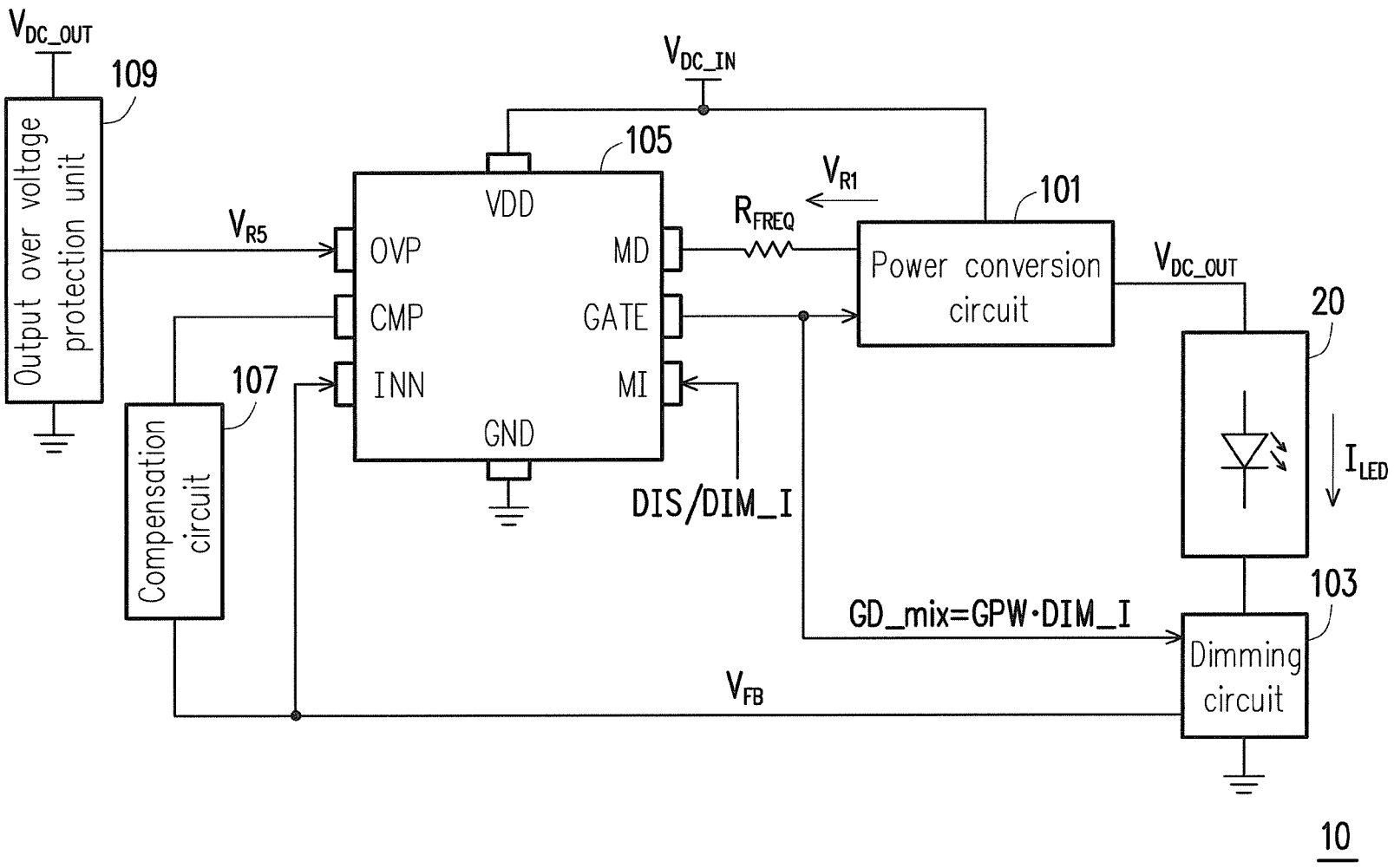
FIG. 1 is a schematic view illustrating a load driving apparatus 10 in an exemplary embodiment of the invention.
Figure 2:
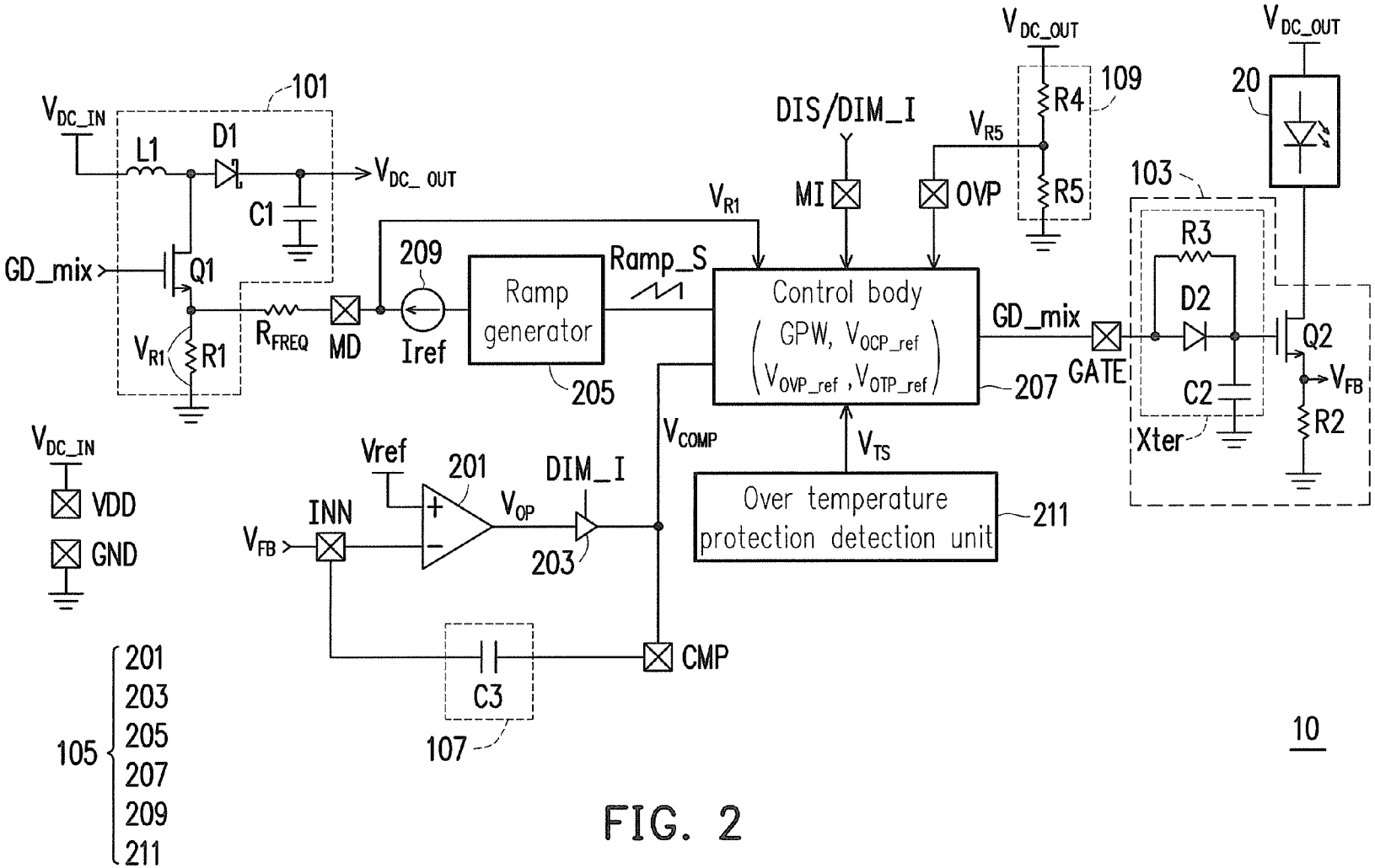
FIG. 2 is a schematic view illustrating implementation of the load driving apparatus 10 in FIG. 1.

FIG. 1 is a schematic view illustrating a load driving apparatus 10 in an exemplary embodiment of the invention. FIG. 2 is a schematic view illustrating implementation of the load driving apparatus 10 in FIG. 1. Please refer to both FIGS. 1 and 2. The load driving apparatus 10 includes a power conversion circuit 101, a dimming circuit 103, a voltage-mode control chip 105, a compensation circuit 107, and an output over voltage protection circuit 109.

The power conversion circuit 101 is configured to receive a DC input voltage $V_{DC_IN}$ and provide a DC output voltage $V_{DC_OUT}$ to at least one LED string 20 (i.e. a plurality of LEDs connected together in forward series) in response to a high frequency component of a complex driving signal GD_mix from the control chip 105.

In the exemplary embodiment, the power conversion circuit 101 may be a DC boost circuit, which may include an inductor L1, a diode (such as a Schottky diode, but the invention is not limited thereto) D1, a capacitor C1, an (N-type) power switch Q1 and a resistor R1.

A first terminal of the inductor L1 is configured to receive the DC input voltage $V_{DC_IN}$. An anode of the diode D1 is coupled to a second terminal of the inductor L1, and a cathode of the diode D1 is coupled to an anode of the LED string 20 to provide the DC output voltage $V_{DC_OUT}$. A first terminal of the capacitor C1 is coupled to the cathode of the diode D1 and a second terminal of the capacitor C1 is coupled a ground potential. A drain of the (N-type) power switch Q1 is coupled to the second terminal of the inductor L1 and the anode of the diode D1, and a gate of the (N-type) power switch Q1 is configured to receive the complex driving signal GD_mix from the control chip 105. The resistor R1 is coupled between a source of the (N-type) power switch Q1 and the ground potential.

On the other hand, the dimming circuit 103 is connected in series with the LED string 20, and configured to adjust a brightness of the LED string 20 in response to a low frequency component of the complex driving signal GD_mix from the control chip 105. In the exemplary embodiment, the dimming circuit 103 may include an (N-type) dimming switch Q2, a resistor R2, and a complex function circuit Xter. A drain of the (N-type) dimming switch Q2 is coupled to a cathode of the LED string 20, and the resistor R2 is coupled between a source of the (N-type) dimming switch Q2 and the ground potential. An input terminal of the complex function circuit Xter receives the complex driving signal GD_mix from the control chip 105; an output terminal of the complex function circuit Xter is coupled to the gate of the dimming switch Q2.

The complex function circuit Xter may be composed of the resistor R3, the capacitor C2, and the diode D2, which should not be construed as a limitation to the invention. A first terminal of the resistor R3 serves as the input terminal of the complex function circuit Xter to receive the complex driving signal GD_mix from the control chip 105. A second terminal of the resistor R3 serves as the output terminal of the complex function circuit Xter and is coupled to the gate of the dimming switch Q2. The capacitor C2 is coupled between the second terminal of the resistor R3 and the ground potential. An anode of the diode D2 is coupled to the first terminal of the resistor R3, and a cathode of the diode D2 is coupled to the second terminal of the resistor R3. It should be noted that, when the complex driving signal GD_mix is at high level, the diode D2 and the capacitor C2 actuate so as to achieve fast turn-on and charging. At this time, the complex function circuit Xter may be regarded as a peak holder. In addition, when the complex driving signal GD_mix is at low level, the capacitor C2 and the resistor R3 actuate to achieve slow discharging. At this time, the complex function circuit Xter may be regarded as a discharging circuit.

The control chip 105 is coupled to the power conversion circuit 101 and the dimming circuit 103, and is configured to: 1) generate a high frequency gate PWM signal GPW in response to a comparison between a compensation voltage $V_{COMP}$ and a ramp signal Ramp_S; 2) generate the complex driving signal GD_mix (=GPW·DIM_I) in response to an "AND" operation of the low frequency dimming input PWM signal DIM_I and the high frequency gate PWM signal GPW to control operation(s) of the power conversion circuit 101 and the dimming circuit 103; and 3) transfer an output voltage $V_{OP}$ as the compensation voltage $V_{COMP}$ to a compensation pin CMP of the control chip 105 in response to an enabling of the low frequency dimming input PWM signal DIM_I. Moreover, the control chip 105 may be further configured to: 4) stop transferring the output voltage $V_{OP}$ to the compensation pin CMP of the control chip 105 in response to a disabling of the low frequency dimming input PWM signal DIM_I.

It should be explained that the high frequency gate PWM signal GPW may be regarded as the high frequency component of the complex driving signal GD_mix, and the low frequency dimming input PWM signal DIM_I may be regarded as the low frequency component of the complex driving signal GD_mix. Also, the frequency of the high frequency gate PWM signal GPW may be of about several hundred KHz (which should not be construed as a limitation to the invention), and the frequency of the low frequency dimming input PWM signal DIM_1 may be of about several hundred Hz (which should not be construed as a limitation to the invention).

Basically, in order to ensure that the control chip 105 operates normally, the control chip 105 may have a power pin VDD to receive the DC input voltage $V_{DC_IN}$ required for operations, and may have a ground pin GND coupled to the ground potential. Accordingly, the control chip 105 may perform a conversion (e.g., boosting/bucking) to the DC input voltage $V_{DC_IN}$, so as to obtain an operating voltage required for internal circuits thereof.

In the exemplary embodiment, the control chip 105 may include an operational voltage amplifier (OP) 201, a switching unit 203, a ramp generator 205, a control body 207, a reference current source 209, and an over temperature protection (OTP) detection unit 211. Certainly, the control chip 105 may include additional function blocks such as a soft start circuit, a brown out circuit, and a counter, etc. depending on actual design/requirement of applications.

The OP 201 is configured to receive a feedback voltage $V_{FB}$ of the resistor R2 and a predeteimined feedback reference voltage Vref, based on which the output voltage $V_{OP}$ is generated. In other words, a positive input terminal (+) of the OP 201 receives the predetermined feedback reference voltage Vref; a negative input terminal (−) of the OP 201 receives the feedback voltage $V_{FB}$ of the resistor R2; and an output terminal of the OP 201 generates the output voltage $V_{OP}$. In the exemplary embodiment, the control chip 105 may further include a feedback pin INN, and the OP 201 may receive the feedback voltage $V_{FB}$ of the resistor R2 via the feedback pin INN. Under normal circumstances, the feedback voltage $V_{FB}$ feedbacked to the feedback pin INN of the control chip 105 may be substantially close to the predetermined feedback reference voltage Vref such as 0.2V, which should not be construed as a limitation to the invention.

The switching unit 203 is coupled to the OP 201, and is configured to at least: 1) receive the output voltage $V_{OP}$ from the OP 201; 2) transfer the output voltage $V_{OP}$ as the compensation voltage $V_{COMP}$ (i.e. Vop=$V_{COMP}$) to the compensation pin CMP of the control chip 105 in response to the enabling of the low frequency dimming input PWM signal DIM_I; and 3) stop transferring the output voltage $V_{OP}$ to the compensation pin CMP of the control chip 105 in response to the disabling of the low frequency dimming input PWM signal DIM_I. In the exemplary embodiment, the switching unit 203 may be implemented by adopting any types of N-type transistor switch, which should not be construed as a limitation to the invention. As long as existing/given functions of the switching unit 203 are present, the switching device may be changed depending on the actual design/requirement of applications.

The ramp generator 205 is configured to generate the ramp signal Ramp_S of which the frequency may be set/adjusted/changed to the control body 207. As for the technical solution concerning how the frequency of the ramp signal Ramp_S is set/adjusted/changed, a detailed explanation will be provided in the following paragraphs.

The control body 207 is coupled to the OP 201 and the ramp generator 205 and is configured to at least: 1) receive the compensation voltage $V_{COMP}$ from the OP 201, the ramp signal Ramp_S from the ramp generator 205, and the external low frequency dimming input PWM signal DIM_I; 2) compare the received compensation voltage $V_{COMP}$ with the ram signal Ramp_S so as to generate the high frequency gate PWM signal GPW; and 3) perform the "AND" operation (·) to the low frequency dimming input PWM signal DIM_1 and the high frequency gate PWM signal GPW so as to generate the complex driving signal GD_mix (=GPW·DIM_I).

In the condition, the control chip 105 may further include a gate output pin GATE, and the control body 207 may control the operation(s) of the power conversion circuit 101 and the dimming circuit 103 by outputting the complex driving signal GD_mix via the gate output pin GATE, i.e. controlling the switching of the (N-type) power switch Q1 and the (N-type) dimming switch Q2. In addition, the control chip 105 may further include a complex function input pin MI, and the control body 207 may receive the low frequency dimming input PWM signal DIM_I via the complex function input pin MI so as to realize the dimming function. Furthermore, the control body 207 may further receive a shutdown signal DIS that keeps to be at a low level for a predetermined time (such as >20 ms, which should not be construed as a limitation to the invention) via the complex function input pin MI, so as to shut down the control chip 105. Apparently, the complex function input pin MI may be provided to perform two functions including dimming the LED string 20 and shutting down the control chip 105. Under normal circumstances, the disabling time of the low frequency dimming input PWM signal DMI_I is less than the predetermined time (i.e. <20 ms).

On the other hand, as shown in FIG. 2, the compensation circuit 107 is coupled to the compensation pin CMP of the control chip 105, and is configured to store the compensation voltage $V_{COMP}$ and to compensate the compensation voltage $V_{COMP}$ so that the power conversion circuit 101 stably provides the DC output voltage $V_{DC_OUT}$. In the exemplary embodiment, the compensation circuit 107 may be a capacitive network (C network), which should not be construed as a limitation to the invention, and may include a capacitor C3. A first terminal of the capacitor C3 is coupled to the compensation pin CMP of the control chip 105. A second terminal of the capacitor C3 is coupled to the feedback pin INN of the control chip 105. However, in other exemplary embodiments for the invention, depending on actual design/requirement of applications, a compensation equivalent resistor and an equivalent capacitor (not shown) may be additionally incorporated to be coupled to the capacitor C3, by serial connection and/or parallel connection and a combination thereof.

It should be noted that, since the compensation circuit 107 stores the compensation voltage $V_{COMP}$ via the capacitor C3 in response to the enabling of the low frequency dimming input PWM signal DIM_I, and is presented in a floating status in response to the disabling of the low frequency dimming input PWM signal DIM_I, it can be taken that the compensation voltage $V_{COMP}$ stored by the compensation circuit 107 does not change with the variation (i.e. enabling and disabling) of the low frequency dimming input PWM signal DIM_I. In other words, regardless of whether the low frequency dimming input PWM signal DIM_I is enabled or disabled, the compensation voltage $V_{COMP}$ on the compensation pin CMP of the control chip 105 remains unchanged.

In addition, to avoid the LED string 20 and/or the internal devices within the load driving apparatus 10 to be damaged due to the impact of the over current (OC), in the exemplary embodiment, the control body 207 may be further configured to determine whether to activate the OC protection mechanism in response to the cross voltage $V_{R1}$ of the resistor R1 and a predetermined over current protection reference voltage $V_{OCP_ref}$. Once the control body 207 determines to activate the over current (OC) protection mechanism, the control body 207 would stop generating the complex driving signal GD_mix in response to the activation of the over current protection mechanism until no occurrence of the over current is found. In this condition, the control chip 105 may further include a complex function detection pin MD, and the control body 207 may receive the cross voltage $V_{R1}$ of the resistor R1 via the complex function detection pin MD so as to determine whether the over current occurs. Apparently, the complex function detection pin MD may be provided to detect the over current.

On the other hand, the complex function detection pin MD may be further provided to set the frequency of the high frequency gate PWM signal GPW. In other words, the complex function detection pin MD may be provided to perform two functions including detecting the over current and setting the frequency of the high frequency gate PWM signal GPW. To be specific, a frequency setting resistor $R_{FREQ}$ is coupled between the first terminal of the resistor R1 and the complex function detection pin MD of the control chip 105. The frequency setting resistor $R_{FREQ}$ may be configured to set the frequency of the high frequency gate PWM signal GPW.

In practical application, during the initial operation period of the load driving apparatus 10, the complex driving signal GD_mix is not generated; the reference current source 209 coupled between the complex function detection pin MD of the control chip 105 and the ramp generator 205 meanwhile provides a reference current Iref only during the same period. In the condition, the ramp generator 205 may be further configured to change the frequency of the ramp signal Ramp_S in response to the reference current Iref and a product voltage (i.e. Ire*$R_{FREQ}$) of the frequency setting resistor $R_{FREQ}$, so as to change the frequency of the high frequency gate PWM signal GPW. Accordingly, since the frequency of the complex driving signal GD_mix outputted by the control chip 105 may be set/adjusted/changed (as long as the resistance of the frequency setting resistor $R_{FREQ}$ is appropriately set), the range/field where the load driving apparatus 10 can be applied is significantly broadened. It should be noted that, since the resistance of the resistor R1 is substantially small, in the initial operation period of the load driving apparatus 10, the resistor R1 does not cause impact on the frequency of the high frequency gate PWM signal GPW that is to be set.

On the other hand, to avoid the LED string 20 and/or the internal devices within the load driving apparatus 10 to be damaged due to the impact of the over voltage (OV), in the exemplary embodiment, the control chip 105 may determine whether to activate the OV protection mechanism by referring to the cross voltage $V_{R5}$ from the output over voltage protection unit 109. In the exemplary embodiment, the output over voltage protection unit 109 is coupled between the DC output voltage $V_{DC_OUT}$ and the ground potential, and is configured to provide the cross voltage $V_{R5}$ relating to the DC output voltage $V_{DC_OUT}$.

To be specific, the output over voltage protection unit 109 may include resistors R4 and R5. A first terminal of the resistor R4 receives the DC output voltage $V_{DC_OUT}$, and a second terminal of the resistor R4 provides the cross voltage $V_{R5}$. The resistor R5 is coupled between a second terminal of the resistor R4 and the ground potential. Apparently, the cross voltage $V_{R5}$ is a divided voltage of the DC output voltage $V_{DC_OUT}$, i.e., $V_{R5}=V_{DC_OUT}*(R5/(R4+R5))$.

Based on the cross voltage $V_{R5}$ provided by the output over voltage protection unit 109, the control body 207 may be further configured to determine whether to activate the over voltage (OV) protection mechanism in response to the cross voltage $V_{R5}$ and a predetermined over voltage protection reference voltage $V_{OVP_ref}$. Once the control body 207 determines to activate the over voltage protection mechanism, then the control body 207 will stop generating the complex driving signal GD_mix in response to the activation of the over voltage protection mechanism until no occurrence of the over voltage is found. In the condition, the control chip 105 may further include an over voltage sense pin OVP, and the control body 207 may receive the cross voltage $V_{R5}$ via the over voltage sense pin OVP, thereby determining whether the over voltage occurs. Certainly, in other exemplary embodiments of the invention, the control body 207 may also adjust the generated complex driving signal GD_mix in response to the cross voltage $V_{R5}$ provided by the output over voltage protection unit 109, which all depends on actual design/requirement of applications.

Furthermore, to avoid the LED string 20 and/or the internal devices within the load driving apparatus 10 to be damaged due to the impact of the over temperature (OT), in the exemplary embodiment, an over temperature protection detection unit 211 coupled to the control body 207 may be configured to provide a temperature sensing voltage $V_{TS}$ relating to the operation temperature of the control chip 105 to the control body 207. In the condition, the control body 207 may be further configured to determine whether to activate the over temperature (OT) protection mechanism in response to the temperature sensing voltage $V_{TS}$ and a predetermined over temperature protection reference voltage $V_{OTP_ref}$. Once the control body 207 determines to activate the over temperature protecting mechanism, then the control body 207 would stop generating the complex driving signal GD_mix in response to the activation of the over temperature protecting mechanism until no occurrence of the over temperature is found.

Based on the above, the control body 207 generates the complex driving signal GD_mix (=GPW·DIM_I) having the high frequency component (i.e. GPW) and the low frequency component (i.e. DIM_I) in response to the input of the low frequency dimming input PWM signal DIM_I to control the operation(s) of the power conversion circuit 101 and the dimming circuit 103. Apparently, by applying the low frequency dimming input PWM signal DIM_I to the complex function input pin MI of the control chip 105, the purpose of adjusting the brightness of the LED string 20 can be realized.

On the other hand, the switching unit 203 transfers the output voltage $V_{OP}$ as the compensation voltage $V_{COMP}$ to the compensation pin CMP of the control chip 105 in response to the enabling of the low frequency dimming input PWM signal DIM_I, thereby allowing the compensation circuit 107 to store and compensate the compensation voltage $V_{COMP}$, such that the power conversion circuit 101 stably provides the DC output voltage $V_{DC_OUT}$. In addition, the switching unit 203 stops transferring the output voltage $V_{OP}$ to the compensation pin CMP of the control chip 105 in response to the disabling of the low frequency dimming input PWM signal DIM_I. Accordingly, since the compensation circuit 107 is in a floating status, the compensation voltage $V_{COMP}$ stored by the compensation circuit 107 does not change in line with the variation (i.e. enabling and disabling) of the low frequency dimming input PWM signal DIM_I. In other words, regardless of whether the low frequency dimming input PWM signal DIM_I is enabled or disabled, the compensation voltage $V_{COMP}$ on the compensation pin CMP of the control chip 105 remains unchanged.

Subsequently, when the low frequency dimming input PWM signal DPW_I changes from the disabling state into the enabling state, since the switching unit 203 is turned on, and a voltage ($V_{OP}$) on the output terminal of the OP 201 immediately becomes the compensation voltage $V_{COMP}$ stored by the compensation circuit 107, the LED string 20 at the current ($I_{LED}$) switching transient does not have the generation of over-shoot current, which is because 1. the compensation voltage $V_{COMP}$ on the compensation pin CMP of the control chip 105 remains unchanged, so that the control body 207 does not generate the full-ON (i.e., the duty cycle being 100%) high frequency gate PWM signal GPW when the LED string 20 is at the current switching transient; and 2. the diode D2 and the capacitor C2 will provide a fast charging mechanism when the low frequency dimming input PWM signal DIM_I is in the enabling status.

Besides, during operations of the load driving apparatus 10, the control body 207 in the control chip 105 continues to monitor cross-voltages ($V_{R1}$, $V_{R5}$) of resistors R1 and R5 and the temperature sensing voltage $V_{TS}$, so as to determine whether the over current and/or over voltage and/or over temperature occurs. Once the control body 207 has determined that occurrence of the over current and/or the over voltage and/or the over temperature is present, the control body 207 immediately stops generating the complex driving signal GD_mix, until no occurrence of the over current and/or the over voltage and/or the over temperature is found.

In light of above, in the invention, the compensation voltage $V_{COMP}$ on the compensation pin CMP of the control chip 105 does not change in response to (or with) variation (enabling or disabling) of the PWM signal for dimming (i.e., the low frequency dimming input PWM signal DPW_I). In other words, regardless of whether the PWM signal for dimming (i.e., the low frequency dimming input PWM signal DPW_I) is enabled or disabled, the compensation voltage $V_{COMP}$ on the compensation pin CMP of the control chip 105 remains unchanged. Therefore, the LED string 20 at the current switching transient does not have the generation of over-shoot current, so as to solve the problems as mentioned in Description of Related Art.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

Any of the embodiments or any of the claims of the invention does not need to achieve all of the advantages or features disclosed by the present invention. Moreover, the abstract and the headings are merely used to aid in searches of patent files and are not intended to limit the scope of the claims of the present invention.

What is claimed is:

1. A load driving apparatus, comprising:

a power conversion circuit configured to provide a direct current (DC) output voltage to a light emitting diode (LED) string in response to a high frequency component of a complex driving signal;

a dimming circuit connected in series with the LED string, and configured to adjust a brightness of the LED string in response to a low frequency component of the complex driving signal;

a control chip coupled to the power conversion circuit and the dimming circuit, and configured to:

generate a high frequency gate pulse-width-modulation signal in response to a comparison between a compensation voltage and a ramp signal;

generate the complex driving signal in response to an "AND" operation of a low frequency dimming input pulse-width-modulation signal and the high frequency gate pulse-width-modulation signal to control operation of the power conversion circuit and the dimming circuit; and transfer the compensation voltage to a compensation pin of the control chip in response to an enabling of the low frequency dimming input pulse-width-modulation signal; and a compensation circuit coupled to the compensation pin, and configured to store the compensation voltage and compensate the compensation voltage so that the power conversion circuit stably provides the DC output voltage, wherein the control chip is further configured to stop transferring the compensation voltage to the compensation pin in response to a disabling of the low frequency dimming input pulse-width-modulation signal, such that the compensation voltage stored by the compensation circuit does not change with variation of the low frequency dimming input pulse-width-modulation signal.

2. The load driving apparatus of claim 1, wherein the power conversion circuit is further configured to receive a DC input voltage and provide the DC output voltage to the LED string in response to the high frequency component of the complex driving signal.

3. The load driving apparatus of claim 2, wherein the power conversion circuit is at least a DC boost circuit, and the DC boost circuit comprises:

an inductor having a first terminal configured to receive the DC input voltage;

a first diode having an anode coupled to a second terminal of the inductor, and a cathode coupled to an anode of the LED string to provide the DC output voltage;

a first capacitor having a first terminal coupled to the cathode of the diode, and a second terminal coupled to a ground potential;

a power switch having a drain coupled to the second terminal of the inductor and the anode of the first diode, and a gate configured to receive the complex driving signal; and a first resistor coupled between a source of the power switch and the ground potential.

4. The load driving apparatus of claim 3, wherein the dimming circuit comprises:

a dimming switch having a drain coupled to a cathode of the LED string;

a second resistor coupled between a source of the dimming switch and the ground potential; and a complex function circuit having an input terminal receiving the complex driving signal and an output terminal coupled to a gate of the dimming switch.

5. The load driving apparatus of claim 4, wherein the complex function circuit comprises:

a third resistor having a first terminal served as the input terminal of the complex function circuit to receive the complex driving signal, and a second terminal served as the output terminal of the complex function circuit and coupled to the gate of the dimming switch;

a second capacitor coupled between the second terminal of the third resistor and the ground potential; and a second diode having an anode coupled to the first terminal of the third resistor and a cathode coupled to the second terminal of the third resistor.

6. The load driving apparatus of claim 5, wherein the control chip further comprises a feedback pin, and the compensation circuit comprises:

a third capacitor coupled between the compensation pin and the feedback pin.

7. The load driving apparatus of claim 6, wherein the control chip comprises:

an operational voltage amplifier configured to receive a feedback voltage of the second resistor and a predetermined feedback reference voltage, and generate an output voltage accordingly;

a switching unit coupled to the operational voltage amplifier and configured to:

receive the output voltage;

transfer the output voltage as the compensation voltage to the compensation pin in response to the enabling of the low frequency dimming input pulse-width-modulation signal; and stop transferring the output voltage to the compensation pin in response to the disabling of the low frequency dimming input pulse-width-modulation signal;

a ramp generator configured to generate the ramp signal; and a control body coupled to the operational voltage amplifier and the ramp generator and configured to:

receive the compensation voltage, the ramp signal, and the low frequency dimming input pulse-width-modulation signal;

compare the compensation voltage with the ramp signal, so as to generate the high frequency gate pulse-width-modulation signal; and perform the "AND" operation to the low frequency dimming input pulse-width-modulation signal and the high frequency gate pulse-width-modulation signal, so as to generate the complex driving signal.

8. The load driving apparatus of claim 7, wherein:

the control chip further comprises a gate output pin, and the control body outputs the complex driving signal via the gate output pin;

the control chip further comprises a complex function input pin, and the control body receives the low frequency dimming input pulse-width-modulation signal via the complex function input pin; and the operational voltage amplifier receives the feedback voltage of the second resistor via the feedback pin.

9. The load driving apparatus of claim 8, wherein the control body further receives a shutdown signal via the complex function input pin so as to shut down the control chip.

10. The load driving apparatus of claim 7, wherein the control body is further configured to determine whether to activate an over current protection mechanism in response to a cross voltage of the first resistor and a predetermined over current protection reference voltage, wherein the control body is further configured to stop generating the complex driving signal in response to activation of the over current protection mechanism.

11. The load driving apparatus of claim 10, wherein the control chip further comprises a complex function detection pin, and the control body receives the cross voltage of the first resistor via the complex function detection pin.

12. The load driving apparatus of claim 11, further comprising:

a frequency setting resistor coupled between a first terminal of the first resistor and the complex function detection pin, and configured to set a frequency of the high frequency gate pulse-width-modulation signal.

13. The load driving apparatus of claim 12, wherein the control chip further comprises:

a reference current source coupled between the complex function detection pin and the ramp generator, and configured to provide a reference current only in an initial operation period of the load driving apparatus, wherein the complex driving signal is not generated during the initial operation period of the load driving apparatus, wherein the ramp generator is further configured to change a frequency of the ramp signal in response to a product voltage of the reference current and the frequency setting resistor, so as to change the frequency of the high frequency gate pulse-width-modulation signal.

14. The load driving apparatus of claim 7, further comprising:

an output over voltage protection unit coupled between the DC output voltage and the ground potential and configured to provide a cross voltage relating to the DC output voltage, wherein the control body is further configured to determine whether to activate an over voltage protection mechanism in response to the cross voltage and a predetermined over voltage protection reference voltage, wherein the control body is further configured to stop generating the complex driving signal in response to activation of the over voltage protection mechanism.

15. The load driving apparatus of claim 14, wherein the output over voltage protection unit comprises:

a fourth resistor having a first terminal receiving the DC output voltage, and a second terminal providing the cross voltage; and a fifth resistor coupled between the second terminal of the fourth resistor and the ground potential.

16. The load driving apparatus of claim 14, wherein the control chip further comprises an over voltage sense pin, and the control body receives the cross voltage via the over voltage sense pin.

17. The load driving apparatus of claim 7, wherein the control chip further comprises:

an over temperature protection detection unit coupled to the control body and configured to provide a temperature sensing voltage relating to an operation temperature of the control chip to the control body, wherein the control body is further configured to determine whether to activate an over temperature protection mechanism in response to the temperature sensing voltage and a predetermined over temperature protection reference voltage, wherein the control body is further configured to stop generating the complex driving signal in response to activation of the over temperature protection mechanism.

18. The load driving apparatus of claim 3, wherein:

the control chip further comprises a power pin receiving the DC input voltage required for operation, the control chip further comprises a ground pin coupled to the ground potential.

* * * * *